United States Patent [19]

Greenwald, Sr.

[11] Patent Number: 4,521,218

[45] Date of Patent: Jun. 4, 1985

[54] PROCESS FOR PRODUCING A COAL-WATER MIXTURE

[76] Inventor: Edward H. Greenwald, Sr., 92 Nancy La., McMurray, Pa. 15137

[21] Appl. No.: 581,538

[22] Filed: Feb. 21, 1984

[51] Int. Cl.[3] ..... C10L 1/32

[52] U.S. Cl. ..... 44/51

[58] Field of Search ..... 44/51

[56] References Cited

U.S. PATENT DOCUMENTS

| | | | |
|---|---|---|---|
| 3,168,350 | 2/1965 | Phinney et al. | 44/51 |
| 3,762,887 | 10/1973 | Clancey et al. | 44/51 |
| 4,217,109 | 8/1980 | Siwersson et al. | 44/1 SR |
| 4,330,301 | 5/1982 | Yamamura et al. | 44/51 |
| 4,406,663 | 9/1983 | Baldwin et al. | 44/51 |
| 4,415,338 | 11/1983 | Schick et al. | 44/51 |
| 4,416,666 | 11/1983 | Funk | 44/51 |

*Primary Examiner*—Y. Harris-Smith

*Attorney, Agent, or Firm*—Thomas H. Murray; Clifford A. Poff

[57] ABSTRACT

A process for producing a coal-water mixture includes classifying a coal feedstock to form first and second coal feed streams each comprised of differently-classified coal particles. Separate surge vessels receive the coal particles to form separate feed streams. The distribution of coal particles in a liquid medium forming each coal feed stream is determined and an electrical signal is delivered to the microprocessor for controlling the portions of each stream which are mixed together in the presence of a dispersing agent and a stabilizing agent to form a coal-water mixture. The coal-water mixture is comprised of at least 65% by weight coal particles and this may be increased to about 82% by controlling the distribution of coal particles in the liquid medium forming each of the coal feed streams.

12 Claims, 1 Drawing Figure

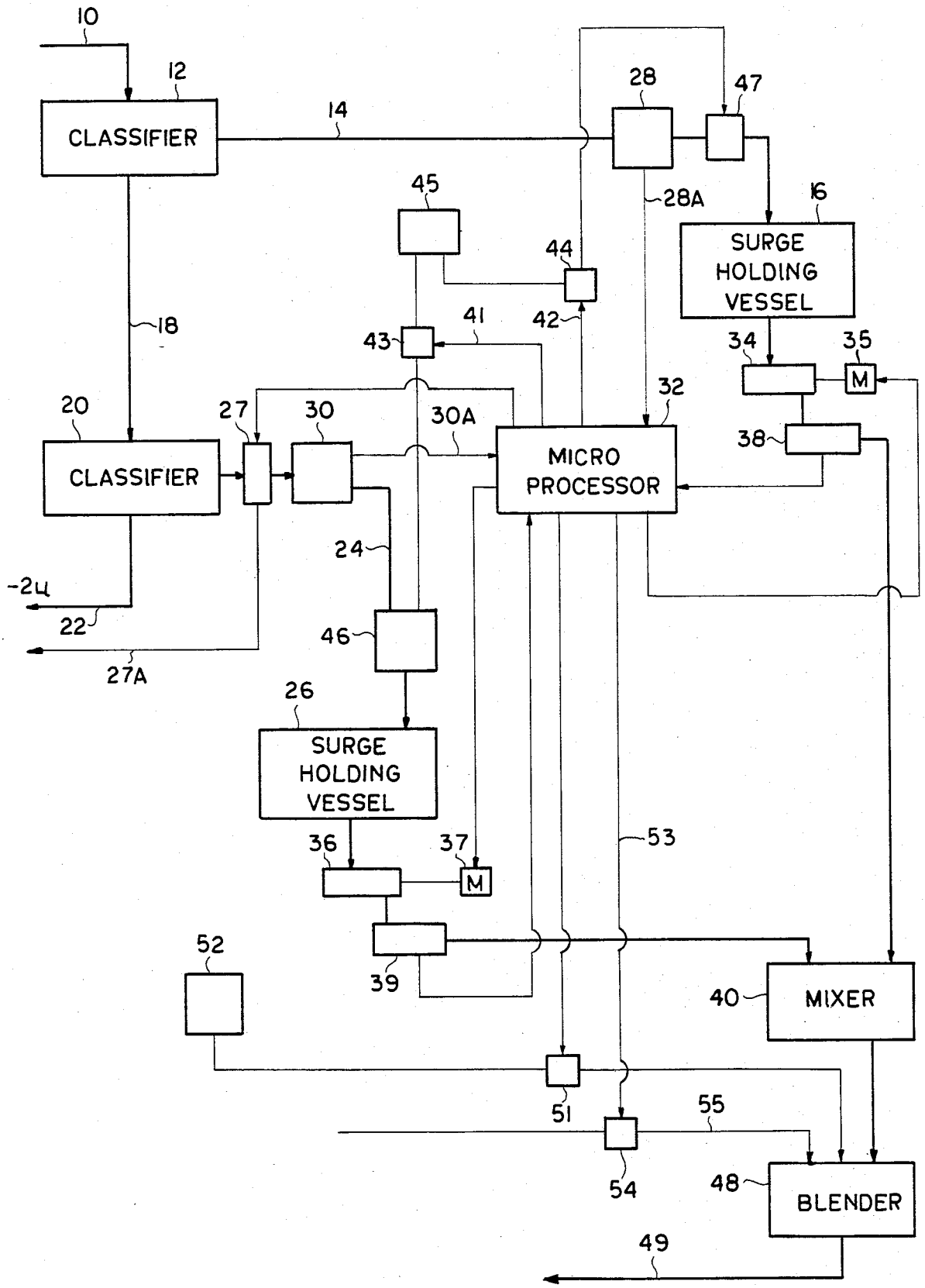
10
12
CLASSIFIER
14
28
47
28A
16
SURGE HOLDING VESSEL
45
44
42
41
43
18
34
35
M
32
20
27
30
30A
38
CLASSIFIER
MICRO PROCESSOR
24
-24
22
27A
46
26
SURGE HOLDING VESSEL
36
37
M
53
52
39
40
MIXER
51
55
54
48
BLENDER
49

PROCESS FOR PRODUCING A COAL-WATER MIXTURE

BACKGROUND OF THE INVENTION

This invention relates to a process to controllably optimize the content of coal particles in a liquid medium forming a coal-water mixture. More particularly, the present invention relates to a process for producing a coal-water mixture from feedstock formed of ground, freshly-mined coal or coal salvaged from silt ponds or other source after processing to remove clay, shale, pyrite and other mineral wherein the feedstock is first classified to form two or more fractions of coal particles in a liquid medium, thereafter concentration of the coal particles in the liquid medium is determined and used for controlling the mixing together of portions of each feed stream to form a coal-water mixture having at least 65% by weight coal particles.

In my copending application Ser. No. 489,586, filed Apr. 28, 1983, there is disclosed a process for removing sulfur and ash from ultrafine coal using a feedstock which may be freshly-mined coal or coal salvaged from silt ponds or other sources. It is suitable, according to the present invention, to use the product from this process to form a coal-water mixture. One characteristic of the coal recovered from silt ponds is the substantial variation and distribution in a flow stream of the sizes of the coal particles on a day-to-day basis and possibly from hour-to-hour of operation of the process after removal of sulfur and ash from the ultrafine coal. In a similar way, a substantial variation to the particle size distribution of ultrafine sizes of freshly-mined coal can be expected when preparing feedstock for a process to form a coal-water mixture. The problem of variations to the particle size distribution of the feedstock exists in all currently-known methods for wet and dry grinding of coal.

In a paper entitled *Rheology of High Solids Coal-Water Mixture* by D. R. Dinger, J. E. Funk, Jr. and J. E. Funk, Sr. 4th International Symposium on Coal Slurry Combustion, May 10–12, 1982, there is described the "rheological properties of a coal-water mixture having 98.5% coal particles at 50 mesh or less depending on the particle-packing efficiency which minimizes interstitial porosity. An equation for optimum particle-packing efficiency is derived and an algorithm developed calculating the porosity of rear particle distributions. The calculated porosity was checked by pressure filtration and measurement of porosity. The specific surface area is also calculated by an algorithm. The data provides a family of particle size distributions which produce exceptional rheological properties provided the surfactant additions are effective for dispersing the coal particles. It was found that monospheres, regardless of their size will usually pack to an average orthorhombic array of about 60% by volume. In order to shear, the structure must open or dilate to a cubic array where the porosity increases from 40% to about 48%. It was found that to prevent dilatancy, or interparticle collisions to shear, the system must be diluted such that the interparticle spacing is at least $IPS=(2-\sqrt{3})D$, where IPS is the interparticle spacing and D is the particle size. The problem arises, however, as to the manner by which a coal-water mixture can be produced comprising at least, for example 65% by weight coal particles and preferably as high as about 82% by weight coal particles on an hourly and a day-to-day basis for reliable use. At about 65% by weight coal particles, a coal-water mixture requires the use of additional fuel such as a combustible gas when used in a power plant. However, the coat-water mixture can be economically utilized. It is, however, far more economical for usage of the coal-water mixture to increase the coal particle concentration to at least 70% by weight coal particles and up to about 82% by weight coal particles. Above 82% by weight coal particles, the delivery of the coal-water mixture by piping networks, pumps and valves will be plagued with mechanical problems.

SUMMARY OF THE INVENTION

It is, therefore, an object of the present invention to provide a process for controlling and optimizing the coal particle distribution in a coal-water mixture.

It is a further object of the present invention to use coal particles recovered from silt ponds or ground, freshly-mined coal to form a coal-water mixture by first classifying the particles to form two or more streams in a liquid medium and mixing together the streams using parts of two or more separately-classified fractions for controlling and optimizing particle size distribution in the final coal-water mixture.

More particularly, according to the present invention, there is provided a process for producing a coal-water mixture wherein the steps include classifying coal feedstock to form at least first and second coal feed streams comprised of differently-classified sizes of coal particles in a liquid medium, determining the concentration of coal particles in the liquid medium in each of the coal feed streams, and mixing together a controlled portion of each stream in the presence of a dispersing and stabilizing agent to form a coal-water mixture comprising at least 65% by weight coal particles.

The invention can be further characterized by combining controlled portions of the coal feed streams to form a supply stream and then adding fluid medium, if necessary, to the supply stream to form a coal-water mixture having a predetermined amount of aqueous medium. Usually, it will be necessary to extract fluid medium from one or more of the coal feed streams so that effective proportions of coal particles from each stream can be mixed together with a controlled quantity of liquid medium to achieve the coal-water mixture comprised of the desired percent coal particles. In carrying out the process, it is preferable to use separate surge vessels to maintain a continuous supply of the first and second coal feed streams. The flow of at least one of the coal feed streams from the surge vessels can be controlled in relation to the delivery of the other feed stream. The coal feed streams are first combined in a mixer and then liquid medium added for blending of the mixture in the presence of a dispersing agent and a stabilizing agent to maintain a uniform dispersion of coal particles in the liquid medium, After blending, the coal-water mixture is conveyed by a pipeline or the like and may be stored in a vessel for future use. In the preferred form of the present invention, each of the coal streams is comprised of coal particles having a size of at least 2 microns. This is because with high ash coal from silt ponds, solids less than 2 microns are mainly ash and, therefore, discarded from the process. One feed stream is typically comprised of coal particles of at least 2 microns and up to about 30 microns. The other feed stream is comprised of coal particles of at least 30 microns up to an upper size limit that is typically not in excess of 300 microns and may be about 150 microns or less.

These features and advantages of the present invention as well as others will be more fully understood when the following description is read in light of the accompanying single FIGURE drawing which illustrates a diagrammatic flow sheet of a practical installation for producing a coal-water mixture according to the present invention.

Feedstock for the process of the present invention may be freshly-mined coal or coal salvaged from silt ponds or other suitable source. The feedstock is processed by conventional state-of-the-art means. Suflur and ash may be removed from the feedstock by the process disclosed in my copending patent application Ser. No. 489,586, filed Apr. 28, 1983. If desired, batching of the feedstock may be carried out in a suitable vessel. The feedstock, which is an aqueous coal slurry, is delivered, preferably at an elevated temperature in the range of 140° F. to 180° F. by line 10 to a classifier 12. A coal slurry at ambient temperature can be used; however at an elevated temperature, the viscosity of the slurry is lower and the moisture content can be more easily controlled. Also, a slurry which is warm can be more thoroughly mixed with the chemicals selected to from a stabilizing agent and a dispersing agent. Some of these chemicals have a liquidus temperature at about 140° F. Classifier 12 is operated to deliver, in line 14, a first aqueous coal fraction comprised of coal particles greater than 30 microns and a small amount of liquid medium. Usually, this first fraction will have flow characteristics of a semi-fluid slurry, e.g., wet cake, and not a liquid. The lower size limit to the particles forming the first fraction is preferably at 30 microns but can be longer, e.g., 50 to 60 microns. The upper size limit to the coal particles of this fraction can be as large as 200 to 300 microns; however particles of 150 microns or less are preferred. Line 14 is connected to deliver the first fraction of coal particles to a surge vessel 16. The minus 30 micron fraction from classifier 12 is delivered by line 18 to a classifier 20. Classifier 20 is operated to effect a sharp separation at 2 microns. The minus 2 micron fraction from classifier 20 is delivered by line 22 to other apparatus for processing or disposal when this fraction contains a substantial amount of ash and, therefore, is not suitable to form part of a coal-water mixture. The remaining 30 micron by 2 micron fraction of coal particles from classifier 20 constitutes the second fraction of coal particles and is delivered by line 24 to a surge vessel 26. This second fraction will usually have the characteristic of a flowable liquid slurry having low viscosity and, therefore, an in-line dewatering device 27 is placed in line 24 to increase the concentration of coal particles in the second feed stream by extracting liquid medium which is discarded from the process by line 27A.

The lines 14 and 24 are provided with particle-concentration monitors 28 and 30, respectively, which deliver electrical signals in lines 28A and 30A to a microprocessor 32. The monitors 28 and 30 are well known in the art, per se, and may be a sonic, a nuclear or a product-sampling type of monitor.

The surge vessels are used to deliver feed streams having a substantially uniform particle distribution in each feed stream. The discharge flow of the first aqueous coal fraction from surge vessel 16 is delivered to a flow controller 34 which may be a valve, but preferably a flow-assisting conveyor or a positive displacement pump driven by a variable speed motor which forms a control element 35. The discharge flow of the second aqueous coal fraction from surge vessel 26 is delivered to a flow controller 36 which also can be a valve, but preferably a flow-assisting conveyor or a positive displacement pump driven by a variable speed motor which forms a control element 37. The control element 35 and 37 respond to separate electrical signals derived from the microprocessor 32 on the basis of a program which utilizes the electrical signals from the monitors and correspond to the concentration of coal particles in each of the first and second feed streams. The program also utilizes electrical signals fed to the microprocessor from volume-measuring or weighing devices 38 and 39 that form part of separate delivery systems for the feed streams issuing from flow controllers 34 and 36, respectively. After weighing, the separate feed streams are combined in a mixer 40 to form a supply stream. The dewatering apparatus 27 is operated to increase the coal particle concentration in the second fraction to the extent that when this fraction is combined with the first fraction, the supply stream has a desired or greater than desired final particle concentration of the coal-water mixture. According to the present invention, the coal-water mixture is comprised of at least 65% by weight coal particles and up to about 82% by weight coal particles. The dewatering apparatus 27 is controlled by an electrical signal from the microprocessor to adjust the combined quantities of aqueous media in the supply stream. It will usually be necessary to control extraction of the aqueous medium by the dewatering apparatus to compensate for quantities of aqueous media that form part of a stabilizing agent that is added to each of the first and second feed streams.

Electrical signals are delivered from the microprocessor in lines 41 and 42 to controllers 43 and 44, e.g., valves or pumps, for controlling the delivery of a dispersing agent from tank 45 to mixers 46 and 47. These mixers can be static, in-line mixers provided in lines 14 and 24, respectively, downstream of the monitors 28 and 30. The dispersing agent can be selected from the group consisting of lignosulfonate, condensed polynuclear hydrocarbons or alkoxylated amine. The dispersing agent is mixed with the feed stream in a blender 48 to prevent separation of the coal particles. The coal particles in the coal-water mixture are compacted in the liquid medium which is delivered by line 49 to a storage tank or site for final usage such as a blast furnace, boiler or the like.

The stabilizing agent can be selected from the group consisting of attapulgite clay, branched macromolecules containing active carbonyl and hydroxyl groups. An electrical signal is delivered from the microprocessor in line 50 to a controller 51, e.g., a valve or pump, for controlling the delivery of the stabilizing agent from a tank 52 to the blender 48. An electrical signal is also provided by the microprocessor in line 53 for controlling a valve 54 in a supply fluid medium supply line 55 extending to the blender 48. Fluid medium is added to the mixture in the blender to adjust the density of coal particles in the final coal-water mixture to the desired extent.

While the foregoing description of the invention utilizes a two-stage classification, proportioning and blending of coal particles, it will now be apparent to those skilled in the art that three or more stages of classification can be used to produce a coal-water mixture. It is important to determine and control the distribution of coal particles within each size fraction, particularly the smaller size particles for subsequent blending together of each fraction of coal particles. In this way, one can control the particle size distribution and, in turn, the density of the coal particles in the coal-water mixture derived from the process.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. In a process for producing a coal-water mixture, the steps comprising:

forming at least first and second coal feed streams comprised of differently-classified coal particle sizes and an aqueous liquid medium, determining the concentration of the coal particles in the aqueous liquid medium forming each of said coal feed streams, and mixing together a portion of each coal feed stream in the presence of a dispersing and stabilizing agent to form a coal-water mixture comprised of at least 65% by weight coal particles.

2. The process according to claim 1 including the further step of extracting aqueous fluid medium from one of said first and second coal feed streams to increase the concentration of coal particles, and wherein said step of mixing includes combining a portion of each of the coal feed streams to form a supply stream, and adding a dispersing and stabilizing agent to the supply stream.

3. The process according to claim 1 including the further step of collecting each of said first and second coal feed streams in separate surge vessels to deliver separate feed streams having substantially uniform particle distribution for said step of mixing.

4. The process according to claim 3 including the further step of controlling the flow of at least one of said coal feed streams from the separate surge vessels.

5. The process according to claim 1 wherein said step of mixing includes combining said feed streams and thereafter adjusting the quantity of aqueous fluid medium in the mixture of the combined feed streams in a mixer together with said dispersing and stabilizing agent to form a coal-water mixture having a desired amount of aqueous medium.

6. The process according to claim 1 including the further step of adding a dispersing agent to each feed stream before said step of mixing and adding a controlled amount of a stabilizing agent in a mixer for forming a coal-water mixture.

7. The process according to claim 1 wherein said step of forming includes forming said first and second streams of coal particles having a size of at least 2 microns.

8. The process according to claim 7 wherein said step of forming further includes forming said first stream of coal particles having a size greater than 30 microns.

9. The process according to claim 1 wherein said step of forming further includes forming said second stream of coal particles ranging in size of at least 2 microns and up to about 30 microns.

10. The process according to claim 1 wherein said coal-water mixture is comprised of about 82% by weight coal particles.

11. The process according to claim 1 wherein said step of determining includes separately weighing unit amounts of each of said coal feed streams to produce corresponding electrical signals, and using said electrical signals for controlling the amounts of each feed stream for said step of mixing.

12. The process according to claim 1 wherein said step of mixing includes blending the controlled portion of each coal feed stream in a blender.

* * * * *